US006370882B1

(12) United States Patent
Adamski et al.

(10) Patent No.: US 6,370,882 B1
(45) Date of Patent: Apr. 16, 2002

(54) TEMPERATURE CONTROLLED COMPARTMENT APPARATUS

(75) Inventors: Joseph R. Adamski, Pasadena; Zhihui Jin, Temple City, both of CA (US)

(73) Assignee: Distinctive Appliances, Inc., Pasadena, CA (US)

( * ) Notice: Subject to any disclaimer, the term of this patent is extended or adjusted under 35 U.S.C. 154(b) by 0 days.

(21) Appl. No.: 09/659,433

(22) Filed: Sep. 8, 2000

(51) Int. Cl.[7] ..... F25B 21/02; F25D 25/02
(52) U.S. Cl. ..... 62/3.6; 62/382
(58) Field of Search ..... 62/3.2, 3.3, 3.6, 62/3.7, 382

(56) References Cited

U.S. PATENT DOCUMENTS 4,364,234 A * 12/1982 Reed ..... 62/3.3
4,782,664 A * 11/1988 Sterna et al. ..... 62/3.3
4,922,721 A * 5/1990 Robertson et al. ..... 62/3.61
5,315,830 A * 5/1994 Doke et al. ..... 62/3.2
5,605,047 A * 2/1997 Park et al. ..... 62/3.6
5,661,978 A * 9/1997 Holmes et al. ..... 62/3.6
6,122,918 A * 9/2000 Johnson et al. ..... 62/3.6

* cited by examiner

*Primary Examiner*—William C. Doerrler
(74) *Attorney, Agent, or Firm*—Lyon & Lyon LLP

(57) ABSTRACT

A temperature controlled compartment apparatus in the form of a kitchen drawer mounted in an interior compartment that is heated or cooled by one or more thermoelectric heat pump modules in a housing surrounding the drawer. A fan circulates air from the drawer past each thermoelectric heat pump module for either heating or cooling the air for the drawer and another fan or fans circulates external air past each thermoelectric heat pump module for cooling or heating, respectively, that external air. Heating or cooling is selected by selecting the polarity of the DC electric source provided to each thermoelectric heat pump module.

20 Claims, 4 Drawing Sheets

TEMPERATURE CONTROLLED COMPARTMENT APPARATUS

This invention relates to an apparatus having a temperature controlled compartment within the apparatus and, in particular, is directed to a kitchen drawer apparatus that may be either heated or cooled for warming or cooling, respectively, plates, containers, food products, and the like or holding the same at a desired temperature.

Many residential kitchens are provided with conventional warming ovens in the form of a drawer that is heated to a desired temperature, usually by electrical heating elements, for various purposes, such as, warming plates before cooked food is served on the plates, warming certain food products to a desired temperature, such as bread or buns, or simply maintaining previously cooked foods at a desired warm temperature without further cooking of the food. Such warming ovens serve many of the purposes of a cooking oven, but usually are of a simpler design, less expensive, smaller and operate a much lower temperature, thereby allowing the cooking oven to be used for cooking some food while other food is being merely warmed or maintained in a warmed condition.

Often it is desirable to chill plates, such as for serving salad or a cold soup, or to maintain a food product cold, such as desserts, leaf salads, beverages or the like. While a conventional residential refrigerator may be used for such a chilling or cooling function, there may be inadequate space or shelving in a residential refrigerator to accommodate plates, bowls, and chilled food products that may be prepared for subsequent service. Further, while an extra small refrigerator may be provided in a residential kitchen for these chilling and cooling functions, conventional refrigerators employ a vapor compression/evaporation cycle requiring a compressor, a condenser and an evaporator which are slow in reducing the interior temperature and, therefore, are normally left on at all times, which is wasteful of energy. Further, heretofore conventional residential refrigerators have not been capable of selectively cooling or heating the interior of the refrigerator.

Therefore, it is a principle object of the present invention to provide a temperature controlled compartment apparatus that may be selectively operated to either heat or cool an interior compartment. Specifically, it is a more detailed object of this invention to provide such an apparatus wherein a thermoelectric heat pump is provided for selective operation either to draw heat from the interior compartment for creating a cooling compartment or to pump heat into the interior compartment for creating a warming compartment. Still another object of the present invention is to provide such an apparatus in the form of an insulated kitchen drawer through which either hot or cold air is selectively circulated and then past a thermoelectric heat pump for selectively cooling or heating the air.

Other and more detailed objects and advantages of the present invention will appear to those skilled in the art from the following description of a preferred embodiment in connection with the drawings, wherein.

Figure 1:
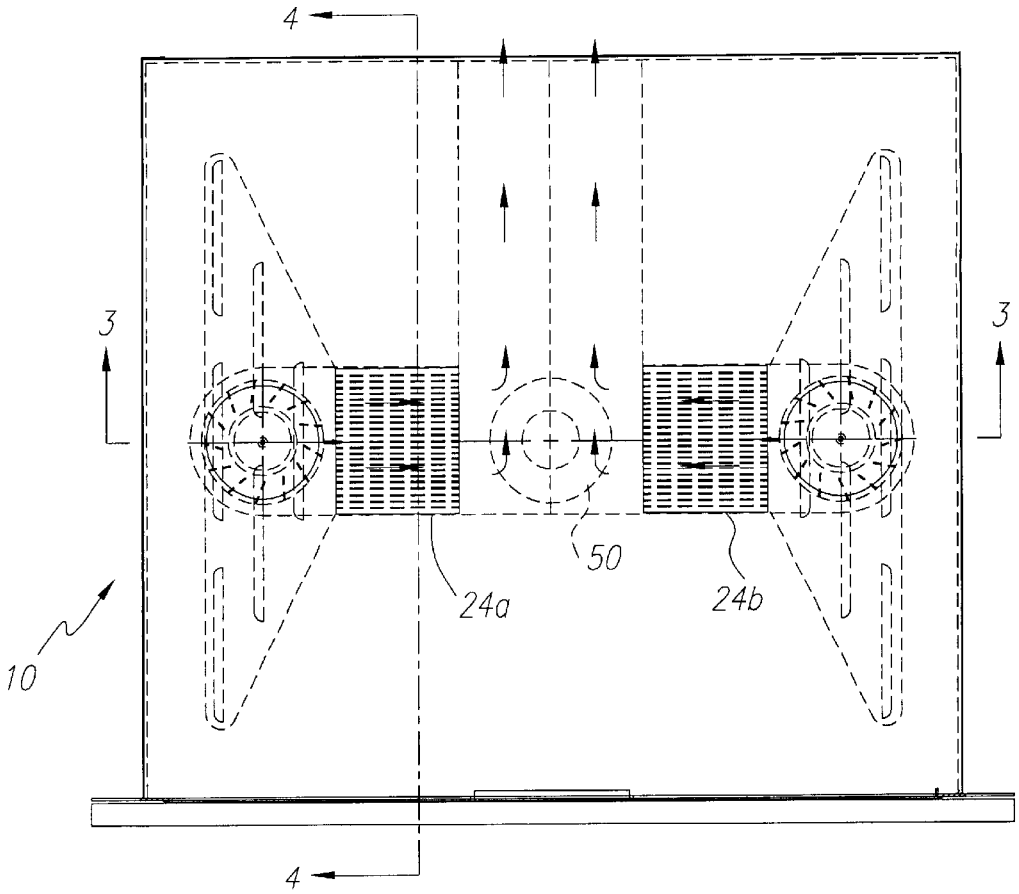
FIG. 1 is a plan view of the temperature controlled compartment apparatus of the present invention in the form of a kitchen drawer for mounting in a cabinet or wall.
Figure 2:
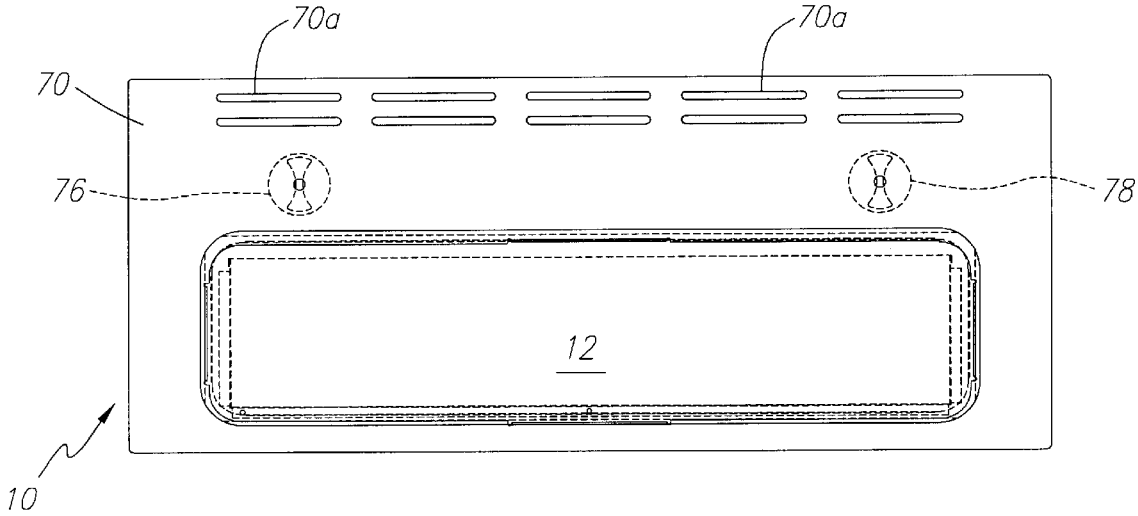
FIG. 2 is a front elevation view of the kitchen drawer apparatus of FIG. 1.
Figure 3:
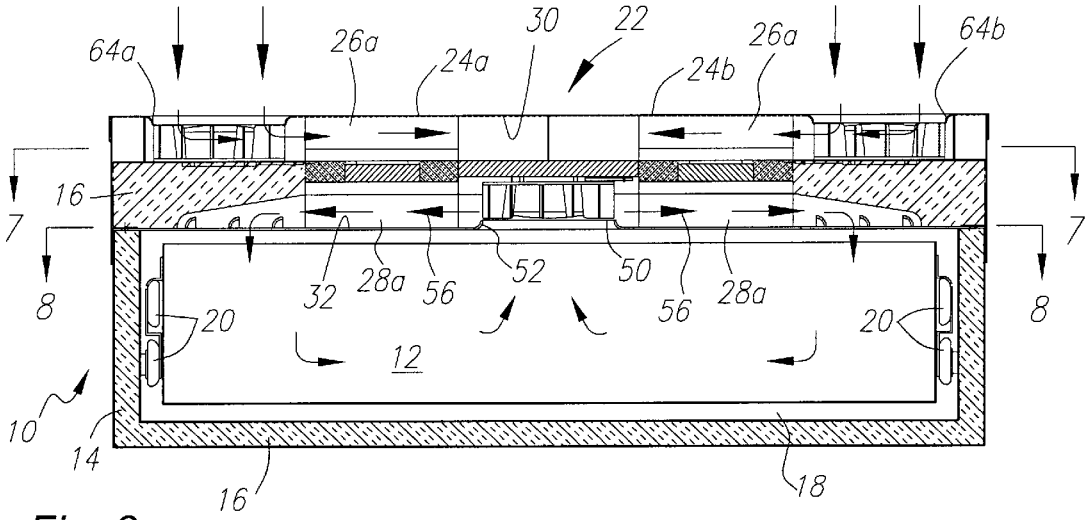
FIG. 3 is a sectional elevation view taken substantially on the line 3—3 of FIG. 1 and illustrating the air circulation paths of the kitchen drawer apparatus.
Figure 4:
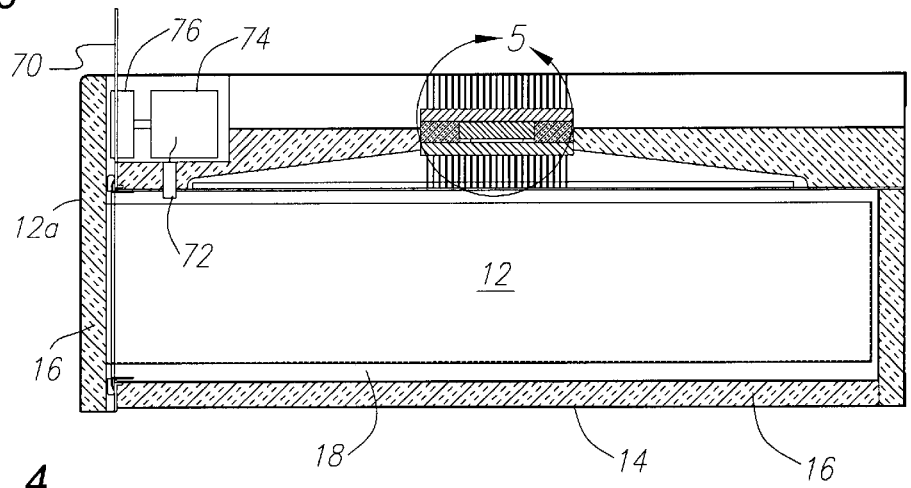
FIG. 4 is a side sectional elevation view taken substantially on the line 4—4 of FIG. 1.

The preferred embodiment of the present invention shown in FIGS. 1–8 is illustrated as an apparatus 10 having a drawer 12 so that the apparatus may be conveniently mounted in an opening in a wall or in the front of a kitchen cabinet, similar to mounting of conventional warming ovens, but the apparatus may be constructed in other configurations, such as merely having a front door, without departing from the present invention. The apparatus 10 includes a double-walled housing 14 with insulation 16 between the walls on all sides, top and bottom, where possible, for reducing undesirable heat transfer between the exterior of the housing and interior compartment 18 formed within the housing 14. The drawer 12 is supported in the housing 14 by rollers 20 in a conventional manner for ease in sliding the drawer 12 in and out of the interior compartment 18. The front 12*a* of the drawer 12 also includes insulation 16.

A heat exchange assemblage, generally designated 22, is provided as the top portion of the apparatus 10 and housing 14 for creating the heat exchange between the interior compartment 18 and the atmosphere above the apparatus 10. In this preferred embodiment, the heat exchange assemblage 12 is provided with two thermoelectric heat pump modules 24*a* and 24*b* (hereinafter simply "thermoelectric module") although a single thermoelectric module or more than two thermoelectric modules may be used without departing from the invention. The thermoelectric modules 24*a* and 24*b* are located between the center of the housing 14 and the left and right, respectively, side walls of the housing 14 and approximately in the center in the front to back direction.

Figure 5:
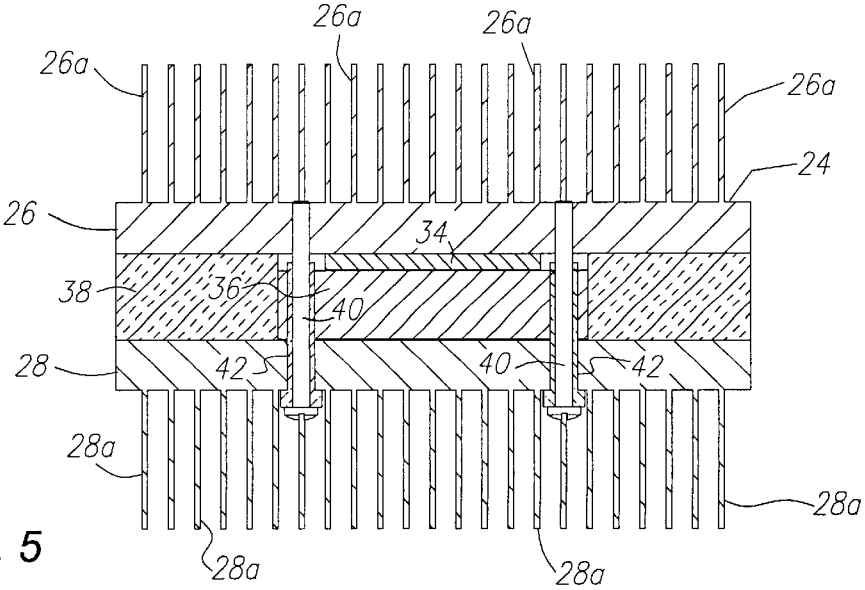
FIG. 5 is an enlarged sectional elevation of one of the thermoelectric heat pump modules used in the apparatus as shown at the circle 5 in the FIG. 4.

As shown in FIG. 5, each thermoelectric module 24 is provided with a pair of heat sinks 26 and 28 in vertically spaced relationship with the upper heat sink 26 having a multiplicity of upwardly extending fins 26*a* and the lower heat sink 28 having a multiplicity of downwardly extending fins 28*a*. Further, the fins 26*a* and 28*a* all extend in the lateral direction from right to left, as viewed in FIGS. 1, 3, 7, and 8, and for the full width of the thermoelectric module 24. As installed in the heat exchange assemblage 22, the top ends of the upwardly extending fins 26*a* engage an upper panel 30 of the heat exchange assemblage 22 and the bottom ends of the downwardly extending fins 28*a* engage a lower panel 32 of the heat exchange assemblage 22. Each thermoelectric module 24 includes a thermocouple heat pump device 34 sandwiched between the heat sinks 26 and 28 with a heat transfer block 36 on one or both sides. Insulation 38 also is sandwiched between the heat sinks 26 and 28 at all locations other than the location of the thermocouple heat pump device 34. The heat sinks 26 and 28 are held together by screws 40 surrounded by thermal washers 42 for minimizing the heat transfer between heat sinks 26 and 28, except through the thermocouple heat pump device 34 and heat transfer block 36.

Figure 6:
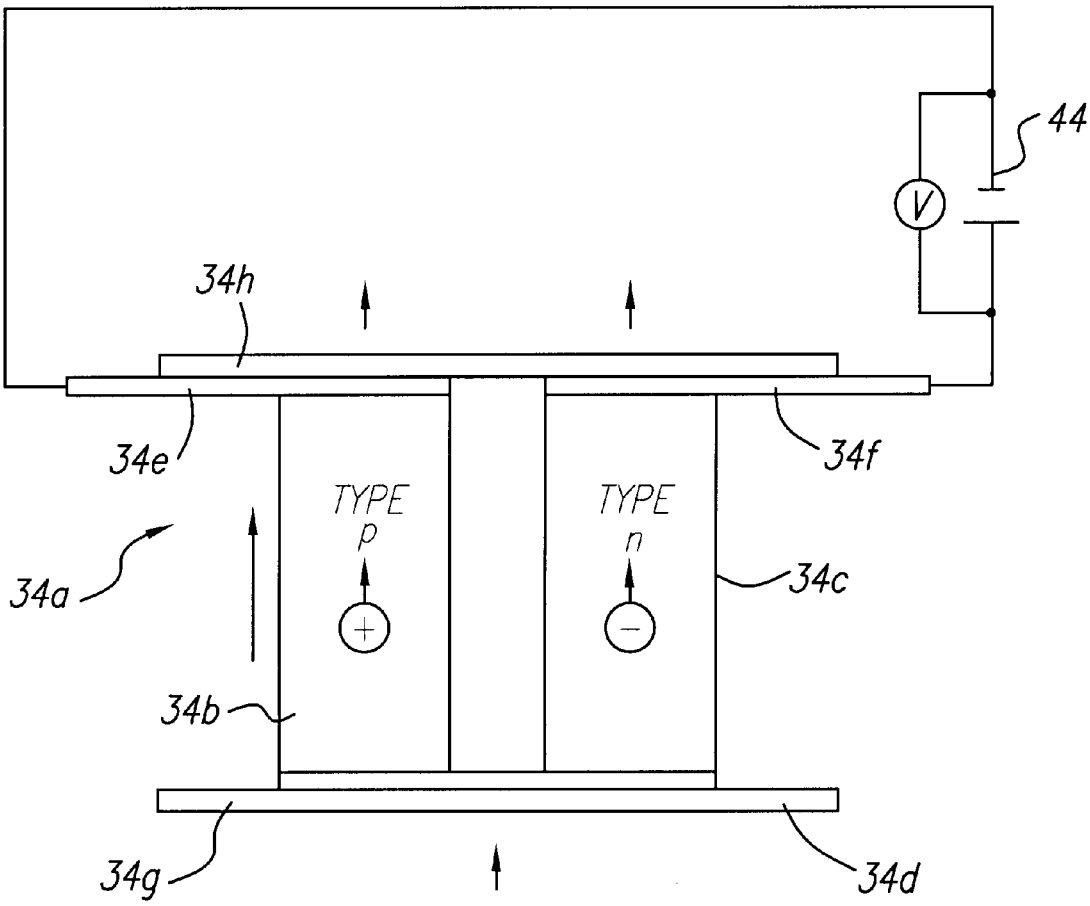
FIG. 6 is a simplified diagrammatic illustration of the structure of the thermocouple elements that form the thermoelectric heat pump modules, such as shown in FIG. 5, that are used in the apparatus of the present invention.
Figure 7:
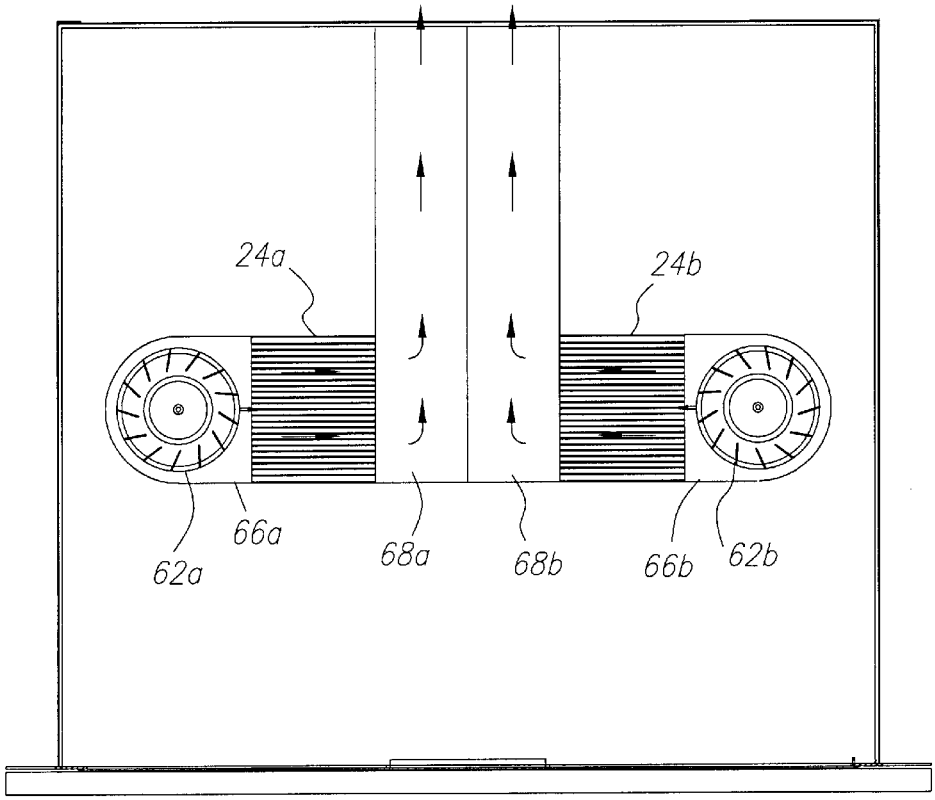
FIG. 7 is a simplified sectional plan view taken substantially on the line 7—7 of FIG. 3 for illustrating the external air circulating arrangement.
Figure 8:
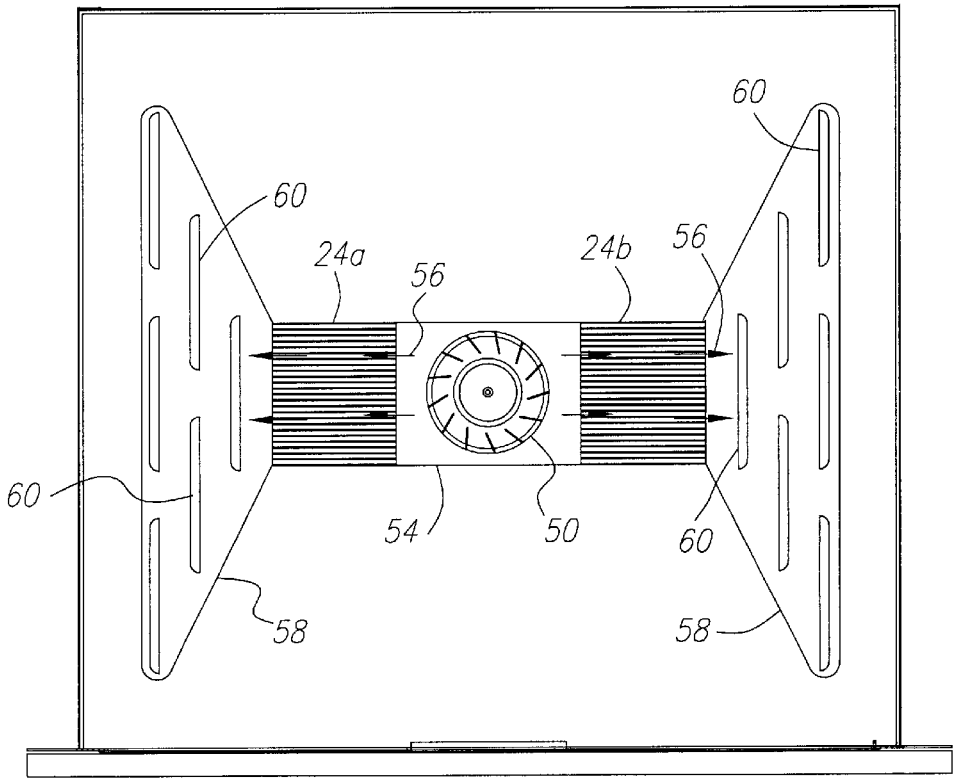
FIG. 8 is simplified sectional plan view taken substantially on the line 8—8 in FIG. 3 for illustrating the internal air recirculating arrangement for the interior compartment.

Referring now to the simplified diagrammatic illustration of FIG. 6, the operation of the thermocouple heat pump device 34 will be described briefly. The thermocouple heat pump device 34 is a solid state semiconductor that may be of any conventional type and normally will be comprised of a plurality of individual thermocouples 34*a* having a "p" type semiconductor material 34*b* and "n" type semiconductor material 34*c,* such as bismuth telluride, sandwiched between a conductor 34*d* that joins the semiconductors 34*b* and 34*c* and conductors 34*e* and 34*f* that are connected to the opposite poles of a DC electrical source 44 for applying a voltage across and a current through the semiconductor materials 34*b* and 34*c*. A metalized ceramic plate 34*g* is provided below conductor 34*d* and another metalized ceramic plate 34*h* is provided above conductors 34*e,* 34*f* for providing electrical insulation and thermal conduction, such as to the heat sinks 26 and 28 (not shown in FIG. 6). When the positive DC voltage is applied to the n-semiconductor material 34*c,* the electrons pass from the p-semiconductor material 34*b* to the n type semiconductor material 34*c* and heat is absorbed through the metallic ceramic plate 34*g* and discharged through the metallic ceramic plate 34*h* to create cold and hot sides, respectively, of the thermocouple 34*a*. If the DC voltage source 44 is reversed, the direction of the heat absorption and discharge is reversed, that is, ceramic plate 34*h* is cooled and ceramic plate 34*g* is heated. By combining a multiplicity of thermocouples 34*a* in electrical series and thermal parallel, a thermocouple heat pump device 34 is created that is capable of developing a substantial temperature differential across the device. Thermocouple heat pump devices of this type are available from various sources, such as Melcor of 1040 Spruce Street, Trenton, N. J. 08648, but it will readily appear to those skilled in the art that similar devices from other sources may be used in the present invention. A single thermocouple heat pump device 34 may be capable of creating a temperature differential of 70° C. or higher thereacross and by stacking such devices a higher temperature differential may be created, although the potential temperature differential across the thermocouple heat pump device does not directly represent the temperature differential that can be created in the mediums on opposite sides, such as the air on the opposite sides of the thermoelectric heat pump module 24 described above.

Referring again more particularly to FIGS. 1, 3, 7 and 8, for convenience the apparatus 10 will be described in connection with its operation in a cooling mode, that is for cooling the drawer 12, but it will readily appear that the apparatus 10 may be operated for heating the drawer 12 by merely reversing the voltage of the DC source 44, as described above. A motorized impeller fan 50 is provided in an opening 52 in the lower panel 32 of the heat exchange assemblage 22 at approximately the center (left to right and front to back) for drawing area from the interior compartment 18 and drawer 12. A duct 54 conducts the air from the fan 50 laterally in both directions, as shown by the arrows 56, between and along the fins 28*a* of the thermoelectric modules 24*a* and 24*b* where heat is absorbed from the circulating air by the fins. The cooled air is discharged from between the fins into laterally spaced plenums 58 and then through a plurality of openings or louvers 60 back into the interior chamber 18 and drawer 12. Thus, with the thermoelectric modules 24*a,* 24*b* and fan 50 energized, the air within interior compartment 18 is continually circulated and cooled for cooling the contents of the drawer 12.

In order to improve the efficiency of and capacity for cooling or heating by the heat exchange assemblage 22, means are provided for circulating external air past the upwardly extending fins 26*a* of the thermoelectric modules 24*a* and 24*b*. Specifically, a pair of motorized impeller fans 62*a* and 62*b* are provided in the heat exchange assemblage 22 at laterally spaced locations in a level above the location of the centrally located fan 50. The fans 62*a* and 62*b* are positioned below openings 64*a* and 64*b,* respectively, in the upper panel 30 for drawing in air from above the apparatus 10. The air is discharged by fans 62*a* and 62*b* through ducts 66*a* and 66*b,* respectively, to and through the spaces between the upwardly extending fins 26*a* on the thermoelectric modules 24*a* and 24*b* where the circulating external air absorbs heat from the fins that has been conducted or pumped through the thermoelectric modules by the thermocouple heat pump device 34. Ducts 68*a* and 68*b* then conduct the heated air toward and through the rear of the apparatus 10 to discharge the air to atmosphere at a sufficient distance from the fans at 62*a* and 62*b* to avoid any direct recirculation of the heated air. Thus, with the fans 62*a,* 62*b* and the thermoelectric heat pump modules 24*a* and 24*b* activated in a manner for cooling the internal chamber 18, the fins 26*a* of the heat sink 26 are continually cooled by the circulating air and the efficiency of the heat exchange assemblage 22 is maximized. While an arrangement with two fans 62*a* and 62*b* has been described for effectively doubling the air circulated past the heat sink fins 26*a* over the quantity of air circulated past the heat sink fins 28*a* to the interior compartment 18 for improving the efficiency, it will be readily understood by those skilled in the art that a single fan or more than two fans may be used. Also, it may be possible to omit the external air fans 62*a,* 62*b* if convection air circulation is adequate for the magnitude of heat transfer. Further, it should be noted that the front wall 70 of the drawer 12 is provided with a plurality of vent openings 70*a* for allowing the fans 62*a* and 62*b* to draw fresh air from the room for cooling, rather than recirculating the air discharged from the ducts 68*a,* 68*b* and ducting may be provided for enhancing this air circulation path.

A temperature probe 72 is provided in the apparatus, such as in the ceiling of the interior compartment 18 (see FIG. 4), and connected to a thermostat 74 for selectively controlling the temperature within the interior chamber 18 and drawer 12 by a selection switch 76. For example, the switch 76 may be provided with a continuously adjustable temperature control or a multiple temperature levels control, i e., high, medium, and low, for the cooling operation in which the polarity of the DC electrical source is established for cooling the interior compartment 18 and, in addition, continuous or multi-level controls for heating the compartment 18 by switching the polarity of the DC electrical source 44. Other controls, such as a timer 78, also may be provided.

While the present invention has been described in connection with a specific preferred embodiment comprising a kitchen drawer that may be either cooled or heated and a specific construction of the heat exchange assemblage for accomplishing heating and cooling, it will really appear to those skilled in the art that various modifications and additions may be made for providing an apparatus for a purpose other than a kitchen drawer or with different components without departing from the invention as claimed below.

The claimed invention is:

1. A temperature controlled compartment apparatus, comprising, a housing with an interior compartment, a drawer mounted in said interior compartment and movable horizontally in and out of said interior compartment, heat exchange means provided in the housing above said interior compartment, said heat exchange means having at least one thermoelectric module operable for transferring heat therethrough with heat exchange fins on upper and lower opposite sides of said thermoelectric module, said heat exchange means having a first air circulating means for drawing air from substantially the horizontal center of said interior compartment and drawer and passing the air between said heat exchange fins on said lower side of said thermoelectric module for changing the air temperature and then returning the air toward horizontally opposite sides of said interior compartment, and said heat exchange means having a second air circulating means horizontally spaced from said first air circulating means for circulating air from externally of said housing passed said heat exchange fins on said upper side of said thermoelectric module.

2. The apparatus of claim 1, wherein said thermoelectric module is operated to cool the air circulated by said first air circulating means to and from said interior compartment.

3. The apparatus of claim 1, wherein said thermoelectric module is operated to heat the air circulated by said first air circulating means to and from said interior compartment.

4. The apparatus of claim 1 wherein two said thermoelectric modules are provided in horizontally spaced relationship.

5. The apparatus of claim 1, wherein separate first ducting and second ducting is provided with said first and second air circulating means, respectively, and insulation is provided between said first ducting and said second ducting.

6. The apparatus of claim 1 or 5 wherein said interior compartment is surrounded by insulation except adjacent said first air circulating means and said heat exchange fins on said lower side of said thermoelectric module.

7. The apparatus of claim 1, wherein said second air circulation means has a substantially larger air circulating capacity than said first air circulating means.

8. The apparatus of claim 1, wherein two said thermoelectric modules are provided in horizontally spaced relationship above said interior compartment, said first air circulating means comprises a single fan located between said two thermoelectric modules, and said second air circulating means comprises two fans located on outer sides of said two thermoelectric modules opposite the location of said single fan.

9. The apparatus of claim 1, further comprising an electrical switch for selecting the polarity of electricity supplied to said thermoelectric module for selectively heating or cooling said interior compartment.

10. The apparatus of claim 1 or 9, further comprising a thermostatic control for said thermoelectric module for controlling the temperature in said interior compartment.

11. A temperature controlled compartment apparatus, comprising, a housing having an interior compartment with insulated left side, right side, bottom and rear walls and an open front;

a drawer mounted in said interior compartment and movable in and out of said open front, said drawer having an insulated front wall closing said open front of said interior compartment;

a heat exchange assemblage on top of said housing and enclosing said interior compartment;

said heat exchange assemblage having a lower panel forming a ceiling of said interior compartment and an upper panel forming a top wall of said housing;

said heat exchange assemblage having a pair of thermoelectric modules mounted between said upper and lower panels in horizontally spaced relationship and operable for transferring heat vertically through said thermoelectric modules;

each said thermoelectric module having upwardly and downwardly extending heat exchange fins engaging said upper panel and lower panel, respectively;

a fan mounted at an opening in said lower panel for drawing air from said interior compartment, passing the air through the downwardly extending heat exchange fins of both said thermoelectric modules and then through vents in said lower panel into said interior compartment for controlling the air temperature in said interior compartment, said vents being horizontally and substantially spaced from said fan opening;

a pair of fans mounted at a pair of spaced openings in said upper panel for drawing air from externally of said housing, separately passing the air through the upwardly extending heat exchange fins of each thermoelectric module and through ducting to exhaust openings horizontally and substantially spaced from said pair of spaced openings; and said heat exchange assemblage including insulation between the path of air circulating to and from said interior compartment passed said downwardly extending heat exchange fins and the paths of external air circulated by said pair of fans passed said upwardly extending heat exchange fins.

12. The apparatus of claim 11, wherein said thermoelectric module is operated to cool the air circulated to and from said interior compartment.

13. The apparatus of claim 11, wherein said thermoelectric module is operated to heat the air circulated to and from said interior compartment.

14. The apparatus of claim 11, wherein said opening in said lower panel for said fan is located in substantially the middle of the ceiling of said interior compartment.

15. The apparatus of claim 14, wherein one said thermoelectric module is located between said right side wall and said opening in the lower panel and the other said thermoelectric module is located between the left side wall and said opening in the lower panel.

16. The apparatus of claim 15, wherein said vents are located between the thermoelectric modules and the adjacent side wall.

17. The apparatus of claim 11 or 16, wherein said vents are comprised of a plurality of louvers extending in the direction from the open front toward the rear wall.

18. The apparatus of claim 11, 14 or 15, wherein said pair of fans are located adjacent the right side wall and left side wall, respectively.

19. The apparatus of claim 11, further comprising an electrical switch for selecting the polarity of electricity supplied to said thermoelectric modules for selectively heating or cooling said interior compartment.

20. The apparatus of claim 11, further comprising a thermostatic control for said thermoelectric modules for controlling the temperature in said interior compartment.

* * * * *